US005715768A

United States Patent [19]

Anderson

[11] Patent Number: 5,715,768

[45] Date of Patent: Feb. 10, 1998

[54] TROLLING PLATE WITH DIRECTIONAL TAILPIECE

[76] Inventor: Mel C. Anderson, 1706 Wagner St., Strasburg, Colo. 80136

[21] Appl. No.: 693,899

[22] Filed: Aug. 5, 1996

[51] Int. Cl.[6] ..... B63H 25/44

[52] U.S. Cl. ..... 114/145 A; 440/900

[58] Field of Search ..... 114/145 A, 145 R, 114/162–164; 440/13, 14, 900, 51, 113; D12/317

[56] References Cited

U.S. PATENT DOCUMENTS

| | | | |
|---|---|---|---|
| 1,257,298 | 2/1918 | Westendarp . | |
| 2,230,958 | 2/1941 | Langdon | 114/145 |
| 2,256,898 | 9/1941 | Ehmke | 114/145 A |
| 2,364,255 | 12/1944 | Troth | 440/14 |
| 2,787,974 | 4/1957 | Johnson | 115/18 |
| 3,117,548 | 1/1964 | Rasmussen | 115/17 |
| 3,473,764 | 10/1969 | Hopper | 440/900 |
| 3,965,838 | 6/1976 | Uht | 114/145 A |
| 4,026,231 | 5/1977 | Fedorko | 114/145 A |
| 4,549,498 | 10/1985 | Meyer et al. | 114/145 A |
| 5,005,507 | 4/1991 | Dyer | 114/280 |

*Primary Examiner*—Edwin L. Swinehart
*Attorney, Agent, or Firm*—John E. Reilly

[57] ABSTRACT

In trolling assembly for slowing the speed of a boat through the water during trolling operations including a trolling plate which can be positioned in the water behind the boat during trolling operations, the improvement comprising a tailpiece substantially traversing the trolling plate in a vertical direction and extending rearwardly therefrom directionally controlling the boat when the assembly is positioned in the water behind the boat. Preferably, the trolling plate is pivotal about a horizontal axis so that it can be raised and lowered from and into the water, and the tailpiece traverses a central opening in the trolling plate so that the tailpiece can divert water flowing through the opening when the boat is turned in either direction.

9 Claims, 2 Drawing Sheets

TROLLING PLATE WITH DIRECTIONAL TAILPIECE

BACKGROUND AND FIELD OF INVENTION

This invention relates generally to devices for regulating the speed of a boat and more specifically relates to a novel and improved trolling plate for attachment behind an outboard motor having a tailpiece which provides improved directional control when the boat is travelling at low speeds during trolling operations.

In the sport of fishing and in commercial fishing operations, it is common to travel at very low speeds, or to troll, for fish. Troll fishing, often done as sport in small boats with outboard motors, requires that the boat be placed in low gear or in idle, which still may cause the boat to travel at a speed too fast for proper trolling. Thus, numerous devices have been developed to slow a boat's speed, even while in idle, during troll fishing by creating an additional drag factor. Such devices are commonly known as trolling plates, and typically are secured to an outboard engine behind the propeller to deflect the propelled water to the sides of the plate and create drag. While trolling plates generally do reduce a boat's speed, the boat's operator may experience a reduced sense of control over the boat's direction and steering when travelling at these extremely low speeds because of the typically flat configuration of the trolling plate and its orientation at right angles to the direction of travel.

A review of the prior art reveals numerous trolling plate assemblies of varying structure contemplated for specific uses, including addressing the problem of reduced directional control at trolling speed.

For instance, U.S. Pat. No. 3,965,838 to Uht shows a backwash baffle and stabilizing device for a propeller driven watercraft that uses a rope control with a trolling plate. U.S. Pat. No. 5,005,507 to Dyer describes a hydrofoil having a retractable plate, the plate pivotally connected to the hydrofoil allowing upright deployment of the plate for slowing of the watercraft. Westendarp, U.S. Pat. No. 1,257,298, discloses a means for controlling and reversing vessels which employs an expansible member between the propeller and the rudder. U.S. Pat. Nos. 2,230,958, 2,787,974, and 3,117,548 to Langdon, Johnson and Rasmussen, respectively, are of general interest as illustrative of the state of the art.

While U.S. Pat. No. 4,549,498 to Meyer et al. shows a speed controlling apparatus having a hinged trolling plate and up to three vanes that extend below the bottommost edge of the deflection plate to impart somewhat of a controlling action upon the boat's movement when the boat is in the trolling position, the angled, downwardly extending vanes of Meyer's device are prone to damage on rocks and other obstacles commonly found in shallow water. In addition, the small size of the vanes relative to the trolling plate provide no real control at slow speeds.

Therefore, a need exists for a trolling plate assembly that can be used on a boat, that can be conveniently raised from and lowered into the trolling position, and which includes a tail piece of a size and shape which will provide an effective means of directionally controlling the boat at extremely slow speeds.

SUMMARY OF THE INVENTION

It is therefore an object of the present invention to provide an improved and novel trolling plate assembly for controlling the speed and direction of marine vehicles.

It is a further object of the present invention to provide a trolling plate which includes means for providing superior directional control of the boat when it is in the trolling mode.

A still further object of the present invention is to utilize a tailpiece in combination with a trolling plate to provide such directional control for a trolling boat.

Yet another object of the present invention is to include means for conveniently raising and lowering the trolling plate assembly along with a highly visible marker to indicate whether the trolling plate assembly is in the raised or lowered position.

In accordance with the present invention, there has been devised for use in a trolling assembly for slowing the speed of a boat through the water during trolling operations wherein the trolling assembly includes a trolling plate which can be positioned in the water behind the boat during trolling operations, the improvement comprising a tailpiece substantially traversing the rear surface of the trolling plate in a vertical direction and extending rearwardly therefrom for directionally controlling the boat when the assembly is positioned in the water behind the boat. Preferably, the trolling plate is pivotal about a horizontal axis so that it can be raised and lowered from and into the water, and the tailpiece traverses a central opening in the trolling plate so that the tailpiece can divert water flowing through the opening when the boat is turned in either direction.

The assembly includes a standard mechanism for raising and lowering the trolling plate generally comprising an adjustment arm extending from the upper end of the plate proximate to its point of attachment to a mounting bracket. An elongated chain or cord is attached to the arm, thus enabling the plate to be raised or lowered from inside of the boat.

The above and other objects and features of the present invention will become more readily appreciated and understood from a consideration of the following detailed description of preferred and modified forms of the present invention when taken together with the accompanying drawings in which:

DETAILED DESCRIPTION OF PREFERRED EMBODIMENT

Figure 1:
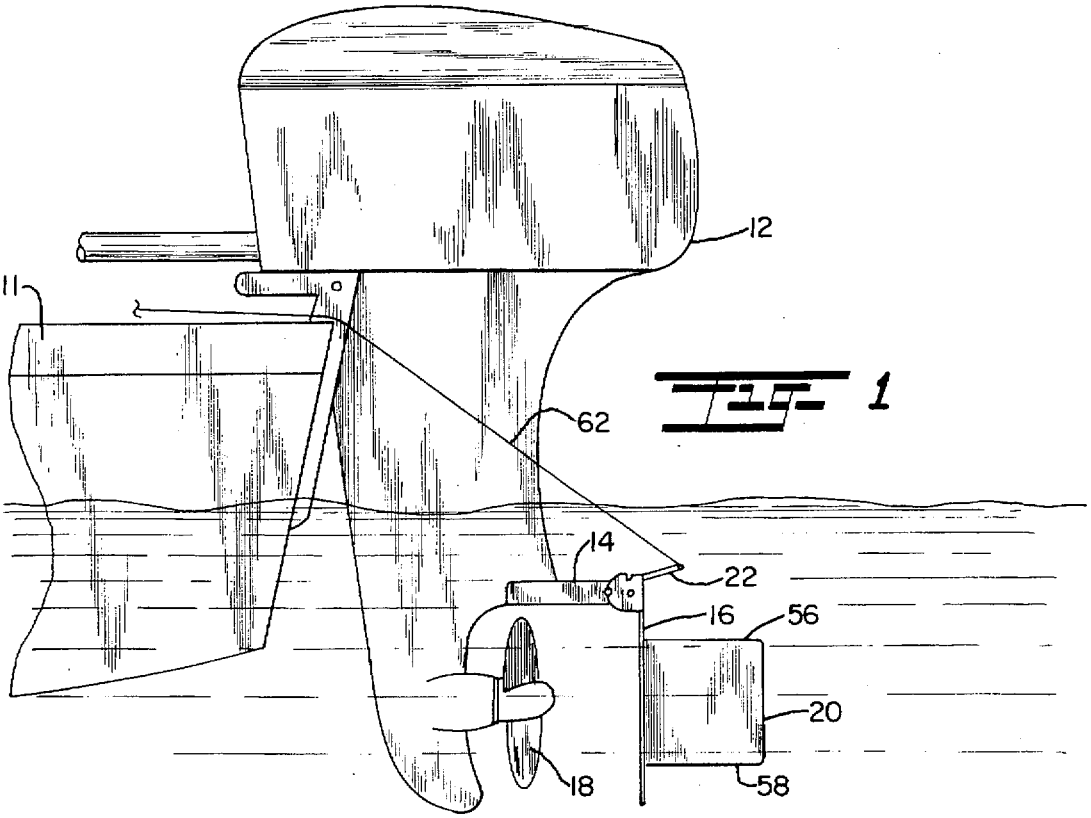
FIG. 1 is a side view in elevation of the trolling plate assembly of the present invention secured to the lower end of an outboard motor.

Referring now to the accompanying drawings wherein like reference numerals designate corresponding structure through out the views, and referring in particular to FIG. 1, the trolling plate assembly of the present invention 10 is contemplated for use with a standard outboard motor 12 during trolling operations when it is desired to travel through the water at relatively low speeds while still maintaining adequate directional control.

As FIG. 1 illustrates, the present invention is broadly comprised of a mounting bracket 14 secured to the lower end of the motor 12 and extending outwardly and rearwardly behind the boat 11. A trolling plate 16 is pivotally connected to the mounting bracket 14, in a manner to be described, and is suspended from the bracket 14, roughly forming a right angle with the bracket 14 such that the plate 16 is disposed in spaced relation to and directly behind the propeller 18. A directional vane or tailpiece 20 is rigidly affixed to the trolling plate 16 and extends rearwardly from the plate 16 to serve as a rudder when the boat 11 is in the trolling mode. As FIG. 1 best shows, the assembly includes a convenient means for raising and lowering the trolling plate 16 and tailpiece 20 from and into the water while inside the boat, such as, an adjustment arm 22 and attached cord 62 assembly, which will be described in more detail below with reference to FIGS. 2 through 4.

Figure 2:
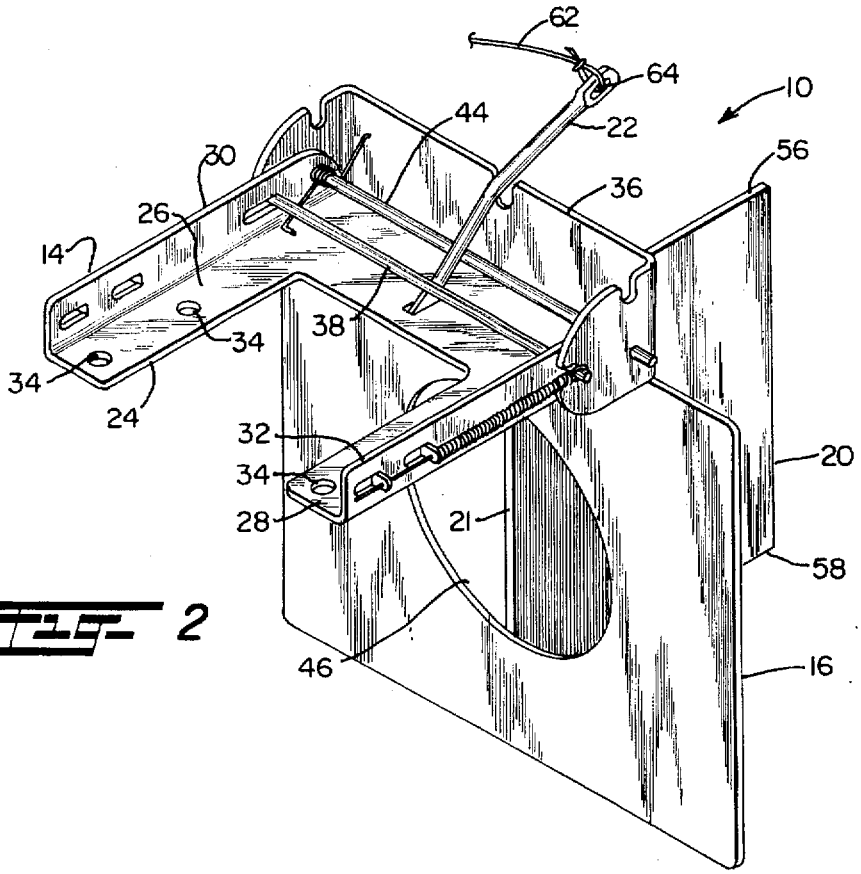
FIG. 2 is a perspective view in more detail of the assembly illustrating the mounting bracket and pivotal trolling plate with tailpiece in accordance with the present invention.
Figure 3:
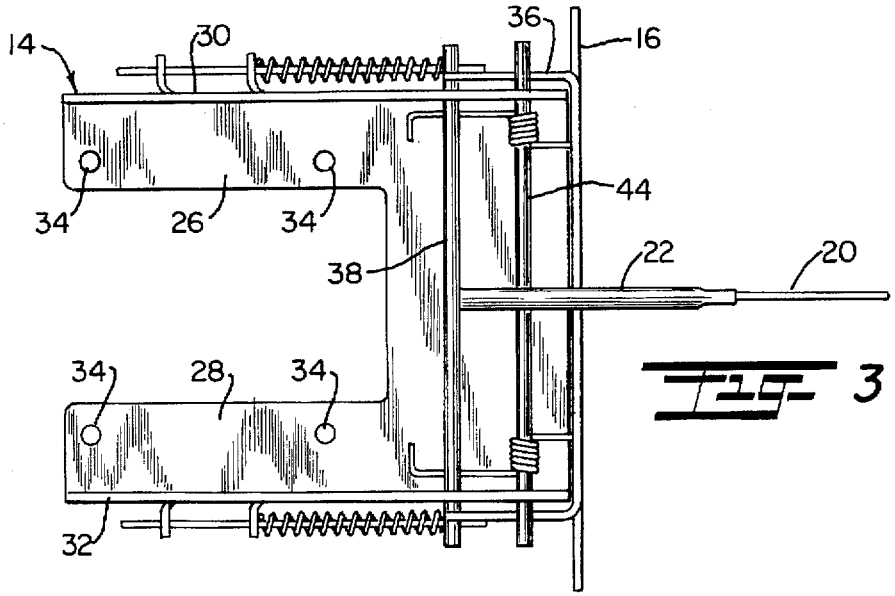
FIG. 3 is a top view of the assembly showing the mounting bracket and adjustment arm.

Turning next to a more detailed description of the assembly 10 as shown in FIGS. 2 and 3, the mounting bracket 14 is of the type often used to secure a standard trolling plate to a boat motor, generally consisting of a U-shaped attachment portion 24 having substantially parallel arms 26, 28, each of which has upwardly extending flanges 30, 32 on its outer edge. The bracket 14 is secured to opposite sides of the motor 14 at its lower end via screws or bolts received through a plurality of openings 34 in the arms 26, 28 and flanges 30, 32.

Serving as the closed end of the bracket 14 is a pivotal endpiece 36 with a first mounting rod 38, the ends of which are received through slots in the respective flanges 30, 32 and corresponding openings 40, 42 in the pivotal endpiece 36.

As best shown in FIGS. 1 and 2, the trolling plate 16 is suspended at its upper end from the pivotal endpiece 36 by a second mounting rod 44 to extend downwardly and generally perpendicularly from the mounting bracket assembly 14, such that the trolling plate 16 hangs directly behind the propeller 18. As shown in FIGS. 1 through 4, the trolling plate 16 may be square in configuration and may include an opening 46 in its center, or as shown in FIG. 5, a circular plate 40 may be employed, which may also have an opening 42 in its center.

As noted above, and with reference to FIGS. 1 through 4, the present invention adds the novel element of a generally rectangular tailpiece 20 rigidly affixed at one end to the rear surface of the trolling plate 16 and extending rearwardly of the assembly in substantially perpendicular relation to the plate 16. As best seen from the modified form of FIG. 5, the tailpiece $\mathbf{20}^1$ may be secured at its upper and lower corners to a rear surface of the circular plate 40 by gussets 23 and 25 so that the leading edge $\mathbf{21}^1$ substantially traverses the vertical dimension of the plate across the center of the opening 42. In the preferred form of FIGS. 1 to 4, the tailpiece 20 is illustrated as having its leading edge 21 joined directly to the rear surface by welding along the leading edge, although it will be apparent that gussets corresponding to the gussets 23 and 25 may similarly be employed in the preferred form.

In this connection, the tailpiece 20 functions as a rudder; i.e., providing improved directional control while steering in the trolling mode. When the plate 16 includes an opening 46 in its center, as shown in FIG. 2, the tailpiece 20 substantially traverses the opening 46, thereby diverting water flowing through the opening when the motor 12 is turned in either direction.

As illustrated in the drawings, the tailpiece 20 is preferably constructed of aluminum of approximately 3/16 inch thickness and is approximately 10 inches in length by four inches in height. With these dimensions, the tailpiece 20 is adapted to be used with a standard 14 inch plate, which may include an opening of approximately four inches in diameter. The assembly 10 could also be constructed using smaller dimensions, in relatively the same proportions.

Figure 4:
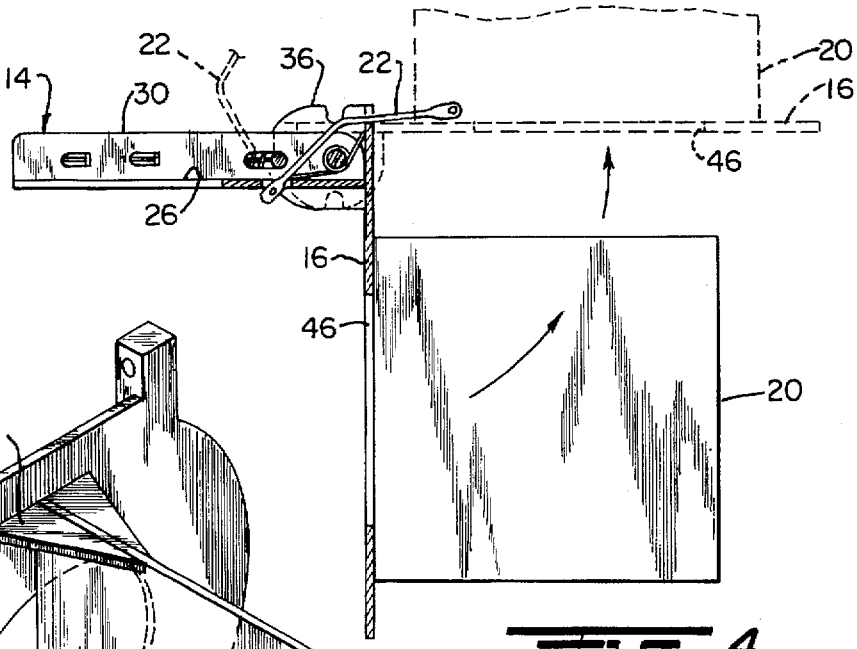
FIG. 4 is a side view of the assembly illustrating the pivotal movement of the trolling plate with tailpiece.
Figure 5:
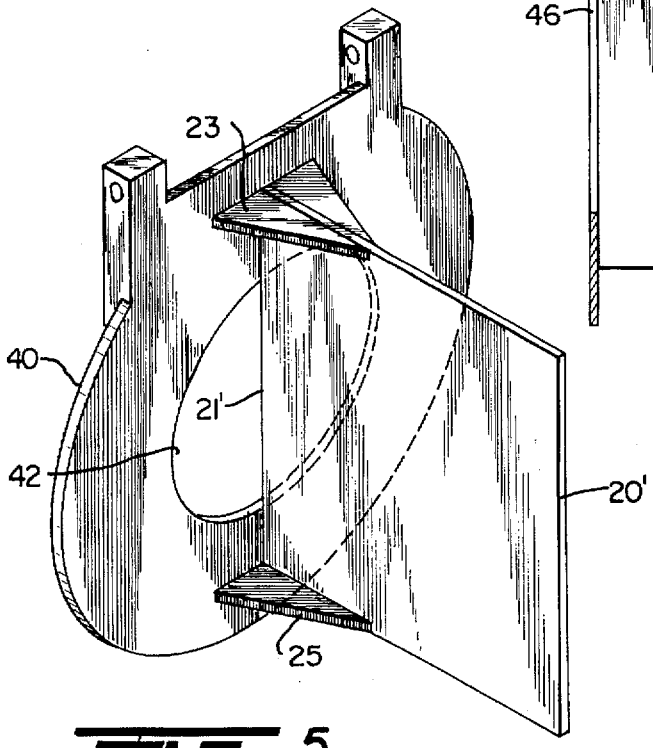
FIG. 5 is a perspective view of the directional tailpiece affixed to the trolling plate.

As best illustrated in FIGS. 2 through 4, the assembly 10 includes means for raising and lowering the plate 16 and tailpiece 20 from and into the water. In this connection, an adjustment arm 22 is pivotally connected to the upper end of the trolling plate 16, and is relatively short in length such that a rope, cord, or chain 62 is looped through an opening 64 at the free end of the adjustment arm 22. When it is desired to raise the plate 16 and tailpiece 20 from the water, the free end of the rope may be pulled by the operator inside the boat. As shown in FIG. 4, the plate 16 will then be oriented substantially perpendicular to the surface of the water with the tailpiece 20 extending upwardly therefrom.

Although not shown in the drawings, this invention contemplates the use of highly visible colored markings on the tailpiece 20, such as, black and yellow, to indicate to the operator of the boat whether the plate is in the raised or lowered positions shown in FIG. 4.

As thus described, the present invention effectively resolves the problems associated with lack of directional control when trolling at lower speeds with its rudder-like tailpiece used with a standard trolling plate, while also providing a convenient means for adjusting the position of the assembly.

It is therefore to be understood that while preferred and modified forms of the invention are herein set forth and disclosed, various other modifications and changes may be made therein without departing from the spirit and scope of the present invention as defined by the appended claims.

I claim:

1. In a trolling assembly for slowing the speed of a boat through the water during trolling operations wherein said assembly includes a trolling plate pivotal about a horizontal axis into a trolling mode wherein said plate is disposed in the water behind said boat, the improvement comprising:

a tailpiece substantially traversing said plate in a vertical direction and extending rearwardly therefrom for directionally controlling said boat when in said trolling mode, wherein said tailpiece substantially traverses a central opening in said plate thereby diverting water flowing through said opening when said motor is turned in either direction.

2. In apparatus according to claim 1 wherein said tailpiece is of generally rectangular configuration.

3. In apparatus according to claim 1 wherein said tailpiece is secured to said plate with gussets and extends substantially perpendicular to said plate, and means for raising and lowering said plate and said tailpiece from and into the water.

4. In apparatus according to claim 3 wherein said means for raising and lowering said plate is selected from the group consisting of an elongated chain or an elongated cord, said cord or said chain attached at one end to an adjustment arm pivotally connected to said trolling plate and adapted to be manipulated at an opposite end from said boat.

5. A trolling apparatus mountable on a boat's outboard motor for controlling the speed and direction of said boat through the water during trolling operations, comprising:

an attachment bracket for mounting said apparatus on a lower end of said motor;

a trolling plate mounted on and extending downwardly from said bracket behind a propeller on said motor, said plate pivotal about a horizontal axis and having front and rear surfaces, said front surface facing said propeller;

a tailpiece rigidly secured at one end to and perpendicularly extending from said rear surface of said plate wherein said one end of said tailpiece substantially traverses said plate between upper and lower edges of said plate; and means for raising said plate from the water and lowering said plate into the water, said means extending from an upper end of said plate and adapted to be operated from said boat, wherein said plate has an opening formed generally in the center of said plate, said one end of said tailpiece substantially traversing said opening to divert water flowing through said opening and provide increased directional control.

6. Apparatus according to claim 5 wherein said tailpiece is of generally rectangular configuration.

7. Apparatus according to claim 5 wherein said opening is substantially circular.

8. Apparatus according to claim 5 wherein said plate is of generally circular configuration.

9. Apparatus according to claim 5 wherein said means for raising and lowering is selected from the group consisting of an elongated chain and cord.

* * * * *